US011971034B2

(12) United States Patent
Kobayashi et al.

(10) Patent No.: US 11,971,034 B2
(45) Date of Patent: Apr. 30, 2024

(54) SCROLL TYPE FLUID MACHINE

(71) Applicant: Hitachi Industrial Equipment Systems Co., Ltd., Tokyo (JP)

(72) Inventors: Yoshio Kobayashi, Tokyo (JP); Shumpei Yamazaki, Tokyo (JP); Sho Watanabe, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/791,255

(22) PCT Filed: Jul. 9, 2020

(86) PCT No.: PCT/JP2020/026864
§ 371 (c)(1),
(2) Date: Jul. 7, 2022

(87) PCT Pub. No.: WO2022/009390
PCT Pub. Date: Jan. 13, 2022

(65) Prior Publication Data

US 2023/0033883 A1 Feb. 2, 2023

(51) Int. Cl.
*F04C 27/00* (2006.01)
*F04C 18/02* (2006.01)

(52) U.S. Cl.
CPC ..... *F04C 27/005* (2013.01); *F04C 18/02* (2013.01)

(58) Field of Classification Search
CPC ..... F04C 27/005; F04C 18/02; F04C 25/02; F04C 18/0284; F04C 18/0207; F01C 19/005
See application file for complete search history.

(56) References Cited

U.S. PATENT DOCUMENTS

2006/0210416 A1 9/2006 Morimoto et al.
2019/0048721 A1* 2/2019 Lamb ..... F01C 19/005
2019/0353162 A1* 11/2019 Ishii ..... F04C 18/0284

FOREIGN PATENT DOCUMENTS

IN MUM-2015-01584 A 10/2016
JP 3-172593 A 7/1991
(Continued)

OTHER PUBLICATIONS

Translation—JP-H06288361-A (Year: 2023).*
(Continued)

*Primary Examiner* — J. Todd Newton
(74) *Attorney, Agent, or Firm* — Crowell & Moring LLP

(57) ABSTRACT

A scroll fluid machine includes: a fixed scroll 11 having a helical wrap 16; an orbiting scroll 12 having a helical wrap 21; a drive shaft 13 that causes the orbiting scroll 12 to orbit relative to the fixed scroll 11; and a helical tip seal 29A inserted into a seal groove 28A of the wrap 21. The tip seal 29A has: a groove 36A that has an opening at a central portion of a sliding surface 30 in the seal width direction; and a communication groove 37A communicating between the inside of the groove 36A and a working chamber $S_H$ on the inner side in the wrap width direction. In groove 36A the differential pressure (PH-PL) is equal to or higher than 0.1 Mpa between the working chamber $S_H$ and a working chamber $S_L$ on the outer side in the wrap width direction.

11 Claims, 9 Drawing Sheets

(56) References Cited

FOREIGN PATENT DOCUMENTS

| | | | | | |
|---|---|---|---|---|---|
| JP | H06288361 | A | * | 10/1994 | ..... F04C 27/005 |
| JP | 7-119657 | A | | 5/1995 | |
| JP | H11148471 | A | * | 11/1997 | |
| JP | 2003-65266 | A | | 3/2003 | |
| JP | 2018-128014 | A | | 8/2018 | |
| JP | 2019-74025 | A | | 5/2019 | |
| WO | WO 2005/038254 | A2 | | 4/2005 | |
| ZA | 200102885 | B | | 7/2002 | |

OTHER PUBLICATIONS

Translation—JP-H11148471-A (Year: 2023).*
International Preliminary Report on Patentability (PCT/IB/338 & PCT/IB/373) issued in PCT Application No. PCT/JP2020/026864 dated Jan. 19, 2023, including English translation of document C2 (Japanese-language Written Opinion (PCT/ISA/237), filed on Jul. 7, 2022) (seven (7) pages).
Hindi-language Office Action issued in Indian Application No. 202217038897 dated Feb. 14, 2023 with English translation (six (6) pages).
International Search Report (PCT/ISA/210) issued in PCT Application No. PCT/JP2020/026864 dated Sep. 29, 2020 with English translation (five (5) pages).
Japanese-language Written Opinion (PCT/ISA/237) issued in PCT Application No. PCT/JP2020/026864 dated Sep. 29, 2020 (five (5) pages).

* cited by examiner

FIRST CONVENTIONAL TECHNOLOGY

SECOND CONVENTIONAL TECHNOLOGY

SCROLL TYPE FLUID MACHINE

TECHNICAL FIELD

The present invention relates to a scroll type fluid machine such as a scroll type compressor or a scroll type vacuum pump.

BACKGROUND ART

Patent Document 1 discloses a scroll type compressor. The scroll type compressor includes a fixed scroll, an orbiting scroll, and a drive shaft. The fixed scroll has an mirror plate and a helical wrap provided upright on the mirror plate. The orbiting scroll has a mirror plate and a helical wrap provided upright on the mirror plate. Rotation of the drive shaft causes the orbiting scroll to orbit relative to the fixed scroll.

A plurality of working chambers are formed between the wrap of the fixed scroll and the wrap of the orbiting scroll. Each working chamber shifts from the outer side to the inner side in the wrap extension direction along with an orbiting motion of the orbiting scroll, and sequentially performs an intake process, a compression process, and a discharge process.

A helical seal groove is formed on the tip side of the wrap of the orbiting scroll, a helical tip seal is inserted into the seal groove, and the sliding surface of the tip seal contacts the mirror plate of the fixed scroll. Similarly, a helical seal groove is formed on the tip side of the wrap of the fixed scroll, a helical tip seal is inserted into the seal groove, and the sliding surface of the tip seal contacts the mirror plate of the orbiting scroll. Thereby, the sealability of the working chambers is enhanced.

Each tip seal in Patent Document 1 has a plurality of recesses formed by cutting off corner portions on one side, in the seal width direction, of the sliding surface mentioned before. The shape of the recess as seen in a direction perpendicular to the sliding surface of the tip seal is a semi-cylindrical shape surrounded by an arc and a straight line or a rectangular shape. The recesses can reduce the area size of the sliding surface, and reduce the friction on the sliding surface.

PRIOR ART DOCUMENT

Patent Document

Patent Document 1: JP-2018-128014-A

SUMMARY OF THE INVENTION

Problem to be Solved by the Invention

Although the friction on the sliding surface of a tip seal is reduced by forming the recesses described in Patent Document 1 on the sliding surface, the surface pressure of the sliding surface does not change. Details thereof are explained.

First, a case where the recesses described in Patent Document 1 are not formed on the sliding surface of a tip seal is explained as a first conventional technology by using FIG. 10. FIG. 10 is a wrap widthwise cross sectional view depicting the structure of a tip seal in the first conventional technology.

As depicted in FIG. 10, a working chamber $S_H$ on the inner side in the wrap width direction (the left side in FIG. 10) and a working chamber $S_L$ on the outer side in the wrap width direction (the right side in FIG. 10) are adjacent to each other with a wrap 1 of an orbiting scroll interposed therebetween. A seal groove 2 is formed on the tip side (the upper side in FIG. 10) of the wrap 1, and a tip seal 3 is inserted into the seal groove 2. The tip seal 3 has a sliding surface 4, an inner surface 5, an outer surface 6, and a bottom surface 7. Due to an effect of the pressure of gas in the working chamber $S_H$ on the high pressure side, a gap R1 between the inner surface 5 of the tip seal 3 and the inner surface of the seal groove 2, and a gap R2 between the bottom surface 7 of the tip seal 3 and the bottom surface of the seal groove 2 are formed. That is, part of the gas in the working chamber $S_H$ flows into the gaps R1 and R2, and a pressure $P_H$ thereof acts on the bottom surface 7 of the tip seal 3. On the other hand, the average pressure that acts on the sliding surface 4 of the tip seal 3 is the average value of the pressure $P_H$ of the gas in the working chamber $S_H$ and a pressure $P_L$ of gas in the working chamber $S_L$. Accordingly, if the width of the tip seal 3 is defined as W, a surface pressure $P_1$ of the sliding surface of the tip seal 3 in a direction (the upward direction in FIG. 10) pressing to a mirror plate 8 of the fixed scroll is represented by the following Formula (1).

[Equation 1]

$$P_1 = \frac{\left(P_H \cdot W - \left(\frac{P_H + P_L}{2}\right) \cdot W\right)}{W} = \frac{P_H - P_L}{2} \tag{1}$$

Next, a case where the recesses described in Patent Document 1 are formed on the sliding surface of a tip seal is explained as a second conventional technology by using FIG. 11. FIG. 11 is a wrap widthwise cross sectional view depicting the structure of a tip seal in the second conventional technology. Note that portions equivalent to their counterparts in the first conventional technology are given the same reference characters, and explanations thereof are omitted as appropriate.

The tip seal 3 has a recess 9 formed by cutting off a corner portion on the inner side (the left side in FIG. 11) of the sliding surface 4 in the seal width direction. Part of the gas in the working chamber $S_H$ flows into the recess 9, and the pressure $P_H$ acts on the bottom surface of the recess 9. Accordingly, if the width of the recess 9 is defined as (⅔)W, a surface pressure $P_2$ of the sliding surface 4 of the tip seal 3 in a direction (the upward direction in FIG. 11) pressing to the mirror plate 8 of the fixed scroll is represented by the following Formula (2).

[Equation 2]

$$P_2 = \frac{\left(P_H \cdot W - P_H \cdot \frac{2}{3}W - \left(\frac{P_H + P_L}{2}\right) \cdot \frac{1}{3}W\right)}{\frac{1}{3}W} = \frac{P_H - P_L}{2} \tag{2}$$

As is apparent from Formulae (1) and (2) described above, the surface pressure of the sliding surface 4 of the tip seal 3 does not change in the first conventional technology and the second conventional technology. Accordingly, there is room for improvement in terms of reduction of the surface pressure of the sliding surface 4 of the tip seal 3, and reduction of the amount of wear of the tip seal 3.

In addition, as is apparent from Formulae (1) and (2) described above, the surface pressure of the sliding surface 4 of the tip seal 3 is proportional to the differential pressure ($P_H$–$P_L$) between the working chamber $S_H$ on the inner side in the wrap width direction and the working chamber $S_L$ on the outer side in the wrap width direction. As depicted in FIG. 12, the differential pressure ($P_H$–$P_L$) changes according to the involute angle (winding angle) of the wrap. If an explanation is given by using the specific example depicted in FIG. 12, the involute angle of the wrap at the inner end (an end at which the winding starts) of the wrap is 3.5 rad, and the involute angle of the wrap at the outer end (an end at which the winding ends) of the wrap is 29.3 rad. The differential pressure ($P_H$–$P_L$) is equal to or higher than 0.1 MPa in a range of the involute angle of the wrap from 6 to 12 rad, and the differential pressure ($P_H$–$P_L$) is lower than 0.1 MPa outside the range. If a relative position is defined such that the involute angle of the wrap at the inner end of the wrap is converted into 0 and the involute angle of the wrap at the outer end of the wrap is converted into 1, the differential pressure ($P_H$–$P_L$) is equal to or higher than 0.1 MPa in a range where the relative position is 0.10 to 0.33, and the differential pressure ($P_H$–$P_L$) is lower than 0.1 MPa outside the range.

In the first or second conventional technology, in a range of the involute angle of the wrap where the differential pressure ($P_H$–$P_L$) is equal to or higher than 0.1 MPa, the surface pressure of the sliding surface of the tip seal increases also. As a result, as depicted in FIG. 13, in the range of the involute angle of the wrap mentioned before, the amount of wear of the tip seal increases also. Accordingly, if the involute angle of the wrap is in the range mentioned before, preferably, the surface pressure of the sliding surface of the tip seal is reduced to suppress wear.

The present invention has been made in view of the matter described above, and one of objects thereof is to suppress wear of a tip seal.

Means for Solving the Problem

Configurations described in Claims are applied in order to solve the problem described above. The present invention includes a plurality of means for solving the problem described above, and one example thereof is a scroll type fluid machine including: a fixed scroll having a mirror plate and a helical wrap provided upright on the mirror plate; an orbiting scroll having a mirror plate and a helical wrap provided upright on the mirror plate; a drive shaft that causes the orbiting scroll to orbit relative to the fixed scroll; and a helical tip seal inserted into a seal groove formed at least in one of the wrap of the fixed scroll and the wrap of the orbiting scroll, a plurality of working chambers being formed between the wrap of the fixed scroll and the wrap of the orbiting scroll, in which the tip seal has: a groove that has an opening at a central portion in a seal width direction on a sliding surface of the tip seal, and a communication hole that establishes communication between an inside of the groove and a working chamber on an inner side in a wrap width direction, the communication hole is shorter than the groove in a seal extension direction, and one of the communication hole is provided for one of the groove.

Advantages of the Invention

According to the present invention, it is possible to suppress wear of a tip seal.

Note that problems, configurations, and advantages other than those described above will become clear from the following explanation.

MODES FOR CARRYING OUT THE INVENTION

A first embodiment to which the present invention is applied is explained with reference to the figures.

Figure 1:
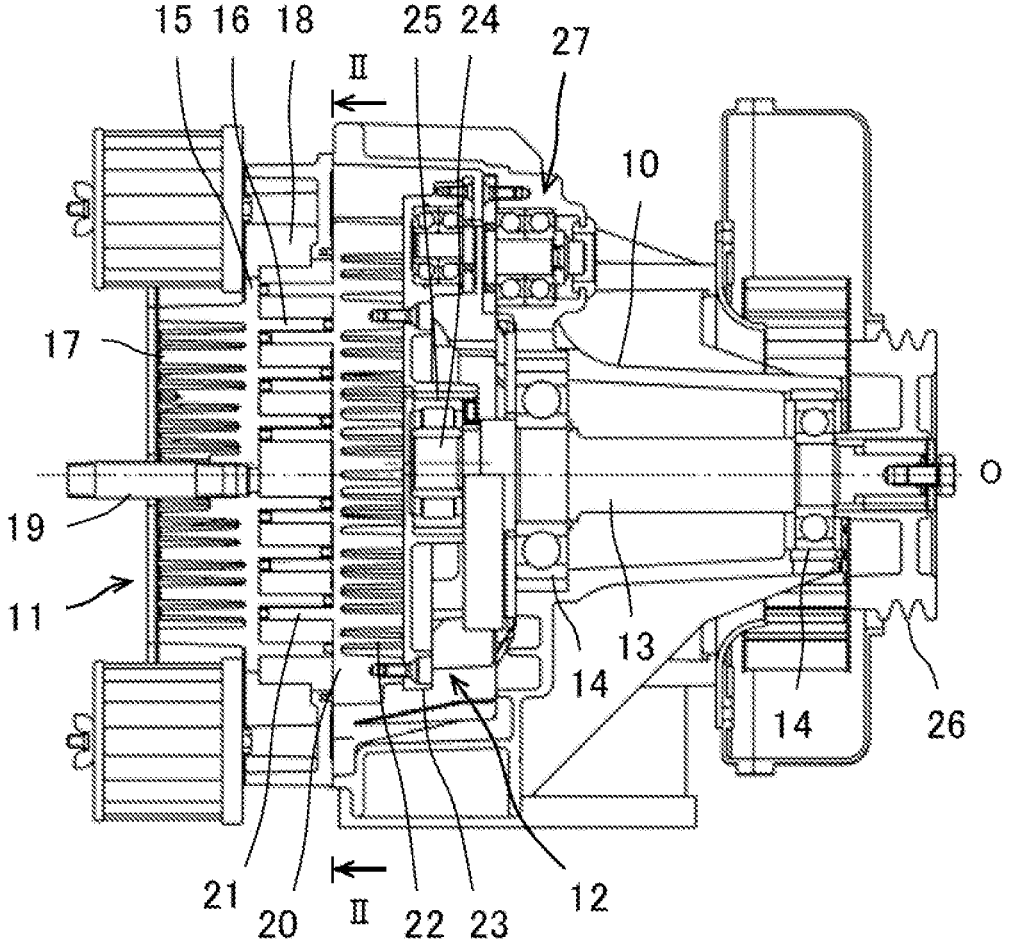
FIG. 1 is an axial cross sectional view depicting the structure of a scroll type compressor in a first embodiment to which the present invention is applied.
Figure 2:
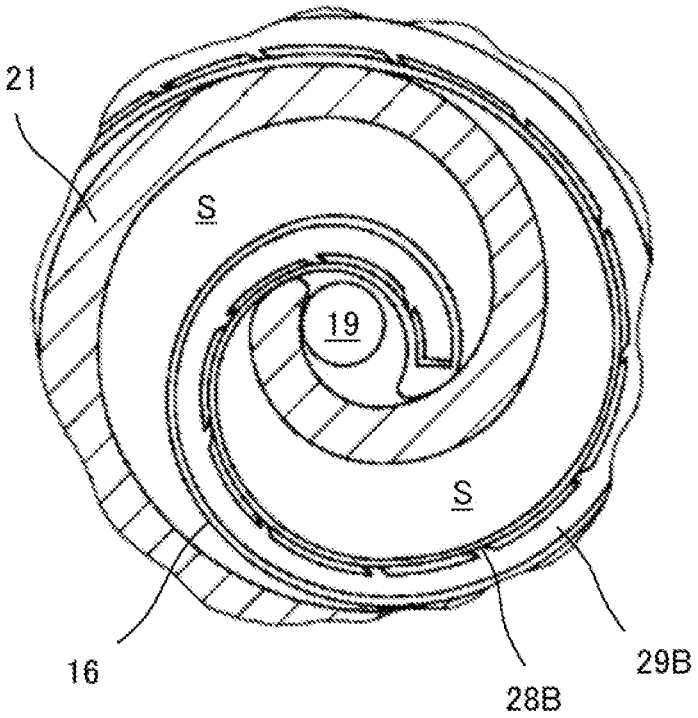
FIG. 2 is a radial cross sectional view in the direction of arrows II-II in FIG. 1.
Figure 3:
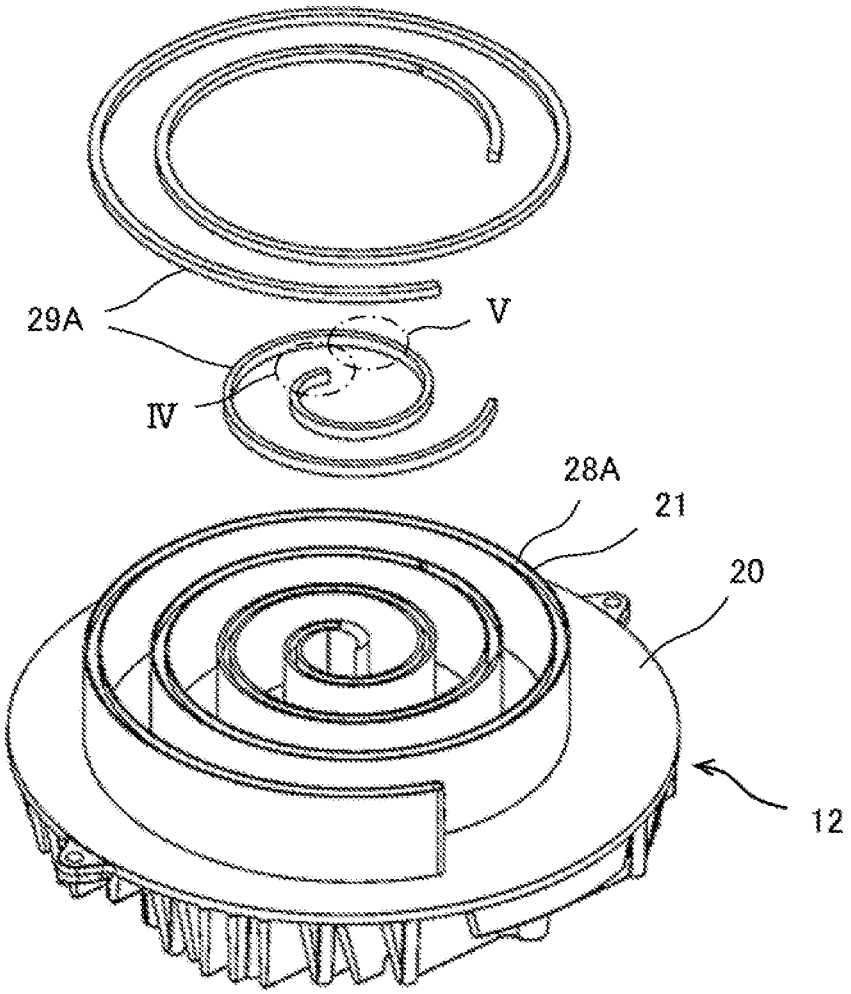
FIG. 3 is an exploded perspective view depicting the structures of an orbiting scroll and a tip seal in the first embodiment to which the present invention is applied.
Figure 4:
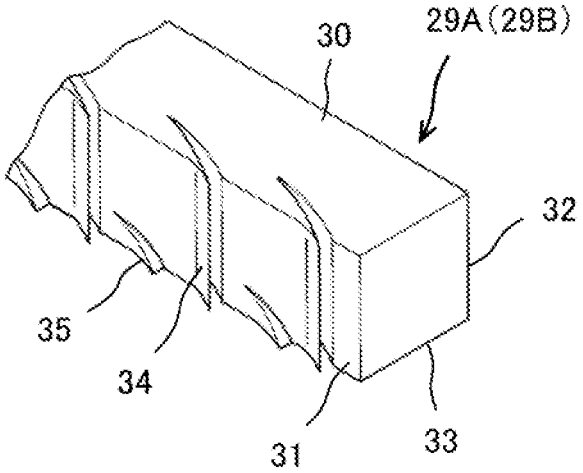
FIG. 4 is a perspective view depicting the structure of part of the tip seal corresponding to a portion IV in FIG. 3.

FIG. 1 is an axial cross sectional view depicting the structure of a scroll type compressor in the present embodiment. FIG. 2 is a radial cross sectional view in the direction of arrows II-II in FIG. 1 (n.b. a central portion in the radial direction is depicted, but an outer portion is not depicted). FIG. 3 is an exploded perspective view depicting the structures of an orbiting scroll and a tip seal in the present embodiment.

A scroll type compressor according to the present embodiment is, for example, an oil-free type scroll compressor (specifically, a compressor in which working chambers are operated in a state free of oil supply), and includes a casing 10, a fixed scroll 11, an orbiting scroll 12, and a drive shaft 13. The fixed scroll 11 is coupled to the opening side of the casing 10. The orbiting scroll 12 is housed in the casing 10. The drive shaft 13 is rotatably supported by a bearing 14 in the casing 10.

For example, the fixed scroll 11 is formed of an aluminum alloy or the like, and has: an approximately circular mirror plate 15; a helical wrap 16 provided upright on one surface side (the right side in FIG. 1) of the mirror plate 15 facing the orbiting scroll 12; and a cooling fin 17 provided upright on the other surface side (the left side in FIG. 1) of the mirror plate 15. An intake flow path 18 is formed on the outer-circumference side of the mirror plate 15, and a discharge flow path 19 is formed at a central portion of the mirror plate 15.

The orbiting scroll 12 is formed of an aluminum alloy or the like, and has: an approximately circular mirror plate 20; a helical wrap 21 provided upright on one surface side (the left side in FIG. 1) of the mirror plate 20 facing the fixed scroll 11; a cooling fin 22 provided upright on the other surface side of the mirror plate 20 (the right side in FIG. 1); and a back plate 23 provided on the tip side (the right side in FIG. 1) of the cooling fin 22.

The drive shaft 13 extends in the horizontal direction (in the leftward/rightward direction in FIG. 1), and one end side thereof (the left side in FIG. 1) is provided with a crank portion 24. The crank portion 24 is eccentric from a center O of the drive shaft 13, and is connected to a boss portion of the back plate 23 of the orbiting scroll 12 via a slewing bearing 25.

The other end side (the right side in FIG. 1) of the drive shaft 13 protrudes to the outside of the casing 10, and is provided with a pulley 26. A belt (not depicted) is wrapped around a pulley (not depicted) provided to a rotation shaft (not depicted) of an electric motor and the pulley 26. Thereby, rotational force of the electric motor is transferred to rotate the drive shaft 13, and the orbiting scroll 12 orbits relative to the fixed scroll 11.

An autorotation prevention mechanism 27 for preventing autorotation of the orbiting scroll 12 is provided between the orbiting scroll 12 and the casing 10. The autorotation prevention mechanism 27 includes: a plurality of auxiliary crank shafts that are arranged spaced apart from each other in the circumferential direction of the drive shaft 13; a plurality of bearings that are provided to the back plate 23 of the orbiting scroll 12, and support one end side of the plurality of auxiliary crank shafts; and a plurality of bearings that are provided to the casing 10, and support the other end side of the plurality of auxiliary crank shafts.

A plurality of working chambers S are formed between the wrap 16 of the fixed scroll 11 and the wrap 21 of the orbiting scroll 12. Each working chamber S shifts from the outer side to the inner side in the wrap extension direction (counterclockwise in FIG. 2) along with an orbiting motion of the orbiting scroll 12, and sequentially performs an intake process, a compression process, and a discharge process. A working chamber S at the intake process takes in air (gas) via the intake flow path 18. A working chamber S at the compression process compresses air. A working chamber S at the discharge process discharges compressed air (compressed gas) via the discharge flow path 19.

A helical seal groove 28A is formed on the tip side (the left side in FIG. 1, and the upper side in FIG. 3) of the wrap 21 of the orbiting scroll 12, a helical tip seal 29A is inserted into the seal groove 28A, and the sliding surface of the tip seal 29A contacts the mirror plate 15 of the fixed scroll 11. Similarly, a helical seal groove 28B is formed on the tip side (the right side in FIG. 1) of the wrap 16 of the fixed scroll 11, a helical tip seal 29B is inserted into the seal groove 28B, and the sliding surface of the tip seal 29B contacts the mirror plate 20 of the orbiting scroll 12. Thereby, the sealability of the working chambers S is enhanced. Note that whereas the tip seal 29A or 29B is divided into two in the present embodiment, this may not be divided.

For example, the tip seal 29A is formed of an elastic resin, and has a sliding surface 30, an inner surface 31, an outer surface 32, and a bottom surface 33. In addition, the tip seal 29A has: a plurality of inner lips 34 that are arranged on the inner surface 31 at predetermined intervals in the seal extension direction; and a plurality of bottom lips 35 that are arranged on the bottom surface 33 at predetermined intervals in the seal extension direction. The inner lips 34 are utilized for partitioning, in the seal extension direction, a gap R1 (see FIG. 6 mentioned later) between the inner surface 31 of the tip seal 29A and the inner surface of the seal groove 28A when the gap R1 is formed. The bottom lips 35 are utilized for partitioning, in the seal extension direction, a gap R2 (see FIG. 6 mentioned later) between the bottom surface 33 of the tip seal 29A and the bottom surface of the seal groove 28A when the gap R2 is formed.

As a feature of the present embodiment, the tip seal 29A has: a groove 36A that has an opening at a central portion of the sliding surface 30 in the seal width direction; and a communication groove 37A (communication hole) that establishes communication between the inside of the groove 36A and a working chamber $S_H$ (see FIG. 6 mentioned later) on the inner side in the wrap width direction. The communication groove 37A has an opening on the sliding surface 30.

The groove 36A is provided in a range of the involute angle of the wrap 21 of the orbiting scroll 12, where a differential pressure ($P_H$–$P_L$) between the working chamber $S_H$ on the inner side in the wrap width direction and the working chamber $S_L$ on the outer side in the wrap width direction which are adjacent to each other with the wrap 21 interposed therebetween (see FIG. 6 mentioned later) is equal to or higher than 0.1 MPa, and additionally, the groove 36A is not provided outside the range. In particular, in the present embodiment, the groove 36A is provided at an involute angle of the wrap 21 where the differential pressure ($P_H$–$P_L$) mentioned before is the highest. The communication groove 37A is shorter than the groove 36A in the seal extension direction.

Figure 12:
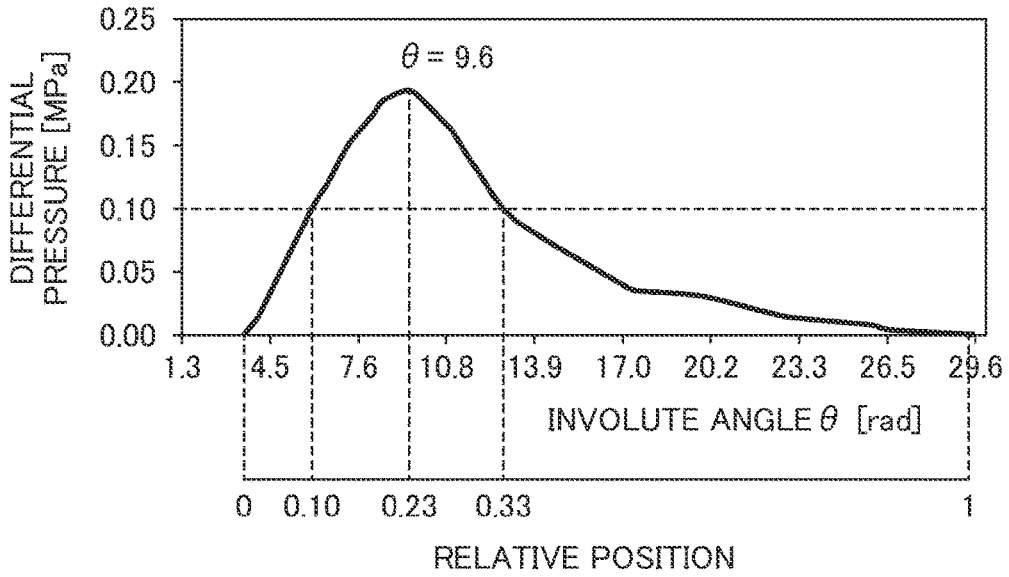
FIG. 12 is a figure depicting the distribution of differential pressure between a working chamber on the inner side in the wrap width direction and a working chamber on the outer side in the wrap width direction which are adjacent to each other with a wrap interposed therebetween.
Figure 13:
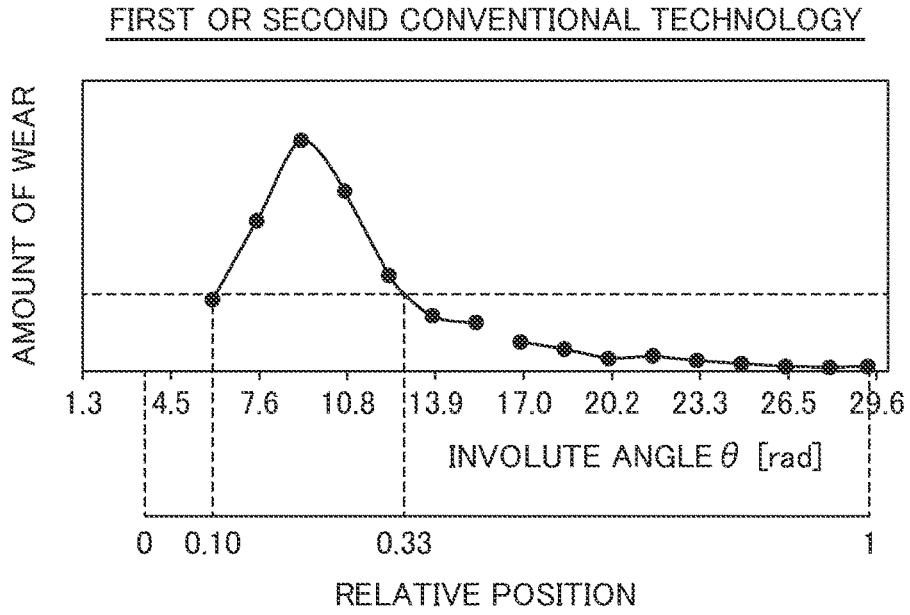
FIG. 13 Prior Art
FIG. 13 is a figure depicting the distribution of the amount of wear of the tip seal in the first or second conventional technology.

Note that if an explanation is given by using the specific example depicted in FIG. 12 mentioned above, the involute angle of the wrap 21 at the inner end (an end at which the winding starts) of the wrap 21 of the orbiting scroll 12 is 3.5 rad, and the involute angle of the wrap 21 at the outer end (an end at which the winding ends) of the wrap 21 is 29.3 rad. The differential pressure ($P_H$–$P_L$) mentioned before is equal to or higher than 0.1 MPa in the range of the involute angle of the wrap 21 from 6 to 12 rad, and the differential pressure ($P_H$–$P_L$) mentioned before is lower than 0.1 MPa outside the range. At a position where the involute angle of the wrap 21 is 9.6 rad, the differential pressure ($P_H$–$P_L$) mentioned before is the highest. If a relative position is defined such that the involute angle of the wrap 21 at the inner end of the wrap 21 is converted into 0 and the involute angle of the wrap 21 at the outer end of the wrap 21 is converted into 1, the differential pressure ($P_H$–$P_L$) mentioned before is equal to or higher than 0.1 MPa in a range where the relative position is 0.10 to 0.33, and the differential pressure ($P_H$–$P_L$) mentioned before is lower than 0.1 MPa outside the range.

Similarly to the tip seal 29A, for example, the tip seal 29B is formed of an elastic resin, and has a sliding surface 30, an inner surface 31, an outer surface 32, and a bottom surface 33. In addition, similarly to tip seal 29A, the tip seal 29B has: a plurality of inner lips 34 that are arranged on the inner surface 31 at predetermined intervals in the seal extension direction; and a plurality of bottom lips 35 that are arranged on the bottom surface 33 at predetermined intervals in the seal extension direction. The inner lips 34 are utilized for partitioning, in the seal extension direction, a gap between the inner surface 31 of the tip seal 29B and the inner surface of the seal groove 28B when the gap is formed. The bottom lips 35 are utilized for partitioning, in the seal extension direction, a gap between the bottom surface 33 of the tip seal 29B and the bottom surface of the seal groove 28B when the gap is formed.

As a feature of the present embodiment, similarly to the tip seal 29A, the tip seal 29B has: a groove 36B that has an opening at a central portion of the sliding surface 30 in the seal width direction; and a communication groove 37B (communication hole) that establishes communication between the inside of the groove 36B and the working chamber $S_H$ on the inner side in the wrap width direction. The communication groove 37B has an opening on the sliding surface 30.

The groove 36B is provided in a range of the involute angle of the wrap 16 of the fixed scroll 11, where a differential pressure ($P_H$–$P_L$) between the working chamber $S_H$ on the inner side in the wrap width direction and the working chamber $S_L$ on the outer side in the wrap width direction which are adjacent to each other with the wrap 16 interposed therebetween is equal to or higher than 0.1 MPa, and additionally, the groove 36B is not provided outside the range. In particular, in the present embodiment, the groove 36B is provided at an involute angle of the wrap 16 at which the differential pressure ($P_H$–$P_L$) mentioned before is the highest. The communication groove 37B is shorter than the groove 36B in the seal extension direction.

Note that if an explanation is given by using the specific example depicted in FIG. 12 mentioned above, the involute angle of the wrap 16 at the inner end (an end at which the winding starts) of the wrap 16 of the fixed scroll 11 is 3.5 rad, and the involute angle of the wrap 16 at the outer end (an end at which the winding ends) of the wrap 16 is 29.3 rad. The differential pressure ($P_H$–$P_L$) mentioned before is equal to or higher than 0.1 MPa in the range of the involute angle of the wrap 16 from 6 to 12 rad, and the differential pressure ($P_H$–$P_L$) mentioned before is lower than 0.1 MPa outside the range. At a position where the involute angle of the wrap 16 is 9.6 rad, the differential pressure ($P_H$–$P_L$) mentioned before is the highest. If a relative position is defined such that the involute angle of the wrap 16 at the inner end of the wrap 16 is converted into 0, and the involute angle of the wrap 16 at the outer end of the wrap 16 is converted into 1, the differential pressure ($P_H$–$P_L$) mentioned before is equal to or higher than 0.1 MPa in a range where the relative position is 0.10 to 0.33, and the differential pressure ($P_H$–$P_L$) mentioned before is lower than 0.1 MPa outside the range.

Next, effects and advantages of the present embodiment are explained.

Figure 5:
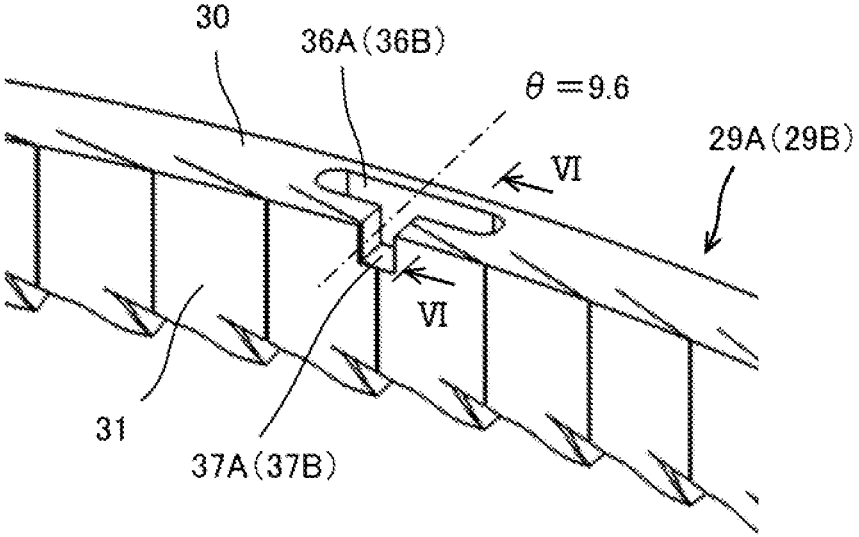
FIG. 5 is a perspective view depicting the structure of a main portion of a tip seal corresponding to a portion V in FIG. 3.
Figure 6:
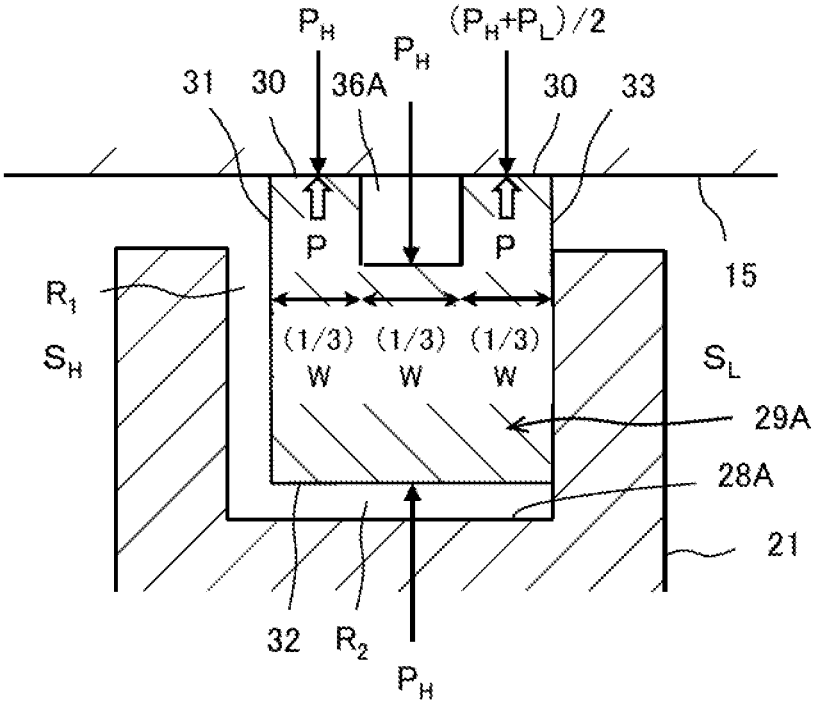
FIG. 6 is a wrap widthwise cross sectional view corresponding to a view in the direction of arrows VI-VI in FIG. 5.

At a cross sectional position having the groove 36A and the communication groove 37A of the tip seal 29A according to the present embodiment, the surface pressure of the sliding surface 30 is not different from the surface pressure in the first or second conventional technology mentioned above. However, at cross sectional positions having the groove 36A, but not having the communication groove 37A, the surface pressure of the sliding surface 30 decreases. Details thereof are explained by using FIG. 6. FIG. 6 is a cross sectional view in the direction of arrows VI-VI in FIG. 5.

As depicted in FIG. 6, the working chamber $S_H$ on the inner side in the wrap width direction (the left side in FIG. 6) and the working chamber $S_L$ on the outer side in the wrap width direction (the right side in FIG. 6) are adjacent to each other with the wrap 21 of the orbiting scroll 12 interposed therebetween. Due to an effect of the pressure of the gas in the high-pressure-side working chamber $S_H$, the gap R1 between the inner surface 31 of the tip seal 29A and the inner surface of the seal groove 28A of the wrap 21, and the gap R2 between the bottom surface 33 of the tip seal 29A and the bottom surface of the seal groove 28A of the wrap 21 are formed. That is, part of the gas in the working chamber $S_H$ flows into the gaps R1 and R2, and the pressure $P_H$ thereof acts on the bottom surface 33 of the tip seal 29A.

On the other hand, part of the gas in the working chamber $S_H$ flows into the groove 36A via the communication groove 37A of the tip seal 29A, and the pressure $P_H$ acts on the bottom surface of the groove 36A. The average pressure that acts on portions positioned on the outer side of the groove 36A in the seal width direction on the sliding surface 30 of the tip seal 29A is the average value of the pressure $P_H$ of the gas in the working chamber $S_H$ and the pressure $P_L$ of the gas in the working chamber $S_L$. The pressure that acts on portions positioned on the inner side of the groove 36A in the seal width direction on the sliding surface 30 of the tip seal 29A is the pressure $P_H$ of the gas in the working chamber $S_H$.

Accordingly, if the full width of the tip seal 29A is defined as W, and each of the widths of the groove and portions on the outer side and inner side in the seal width direction mentioned before is (⅓)W, a surface pressure P of the sliding surface of the tip seal 29A in a direction (the upward direction in FIG. 6) pressing to the mirror plate 15 of the fixed scroll 11 is represented by the following Formula (3).

[Equation 3]

$$P = \frac{\left(P_H \cdot W - P_H \cdot \frac{1}{3}W - P_H \cdot \frac{1}{3}W - \left(\frac{P_H + P_L}{2}\right) \cdot \frac{1}{3}W\right)}{\frac{2}{3}W} = \frac{P_H - P_L}{4} \quad (3)$$

As is apparent from Formulae (1) to (3) described above, at cross sectional positions having the groove 36A, but not having the communication groove 37A of the tip seal 29A according to the present embodiment, the surface pressure of the sliding surface 30 decreases as compared to the first or second conventional technology.

The groove 36A is provided in a range of the involute angle of the wrap 21 where the differential pressure ($P_H$–$P_L$) between the working chamber $S_H$ and the working chamber $S_L$ is equal to or higher than 0.1 MPa. That is, the groove 36A is provided in a range of the involute angle of the wrap 21 where the surface pressure of the sliding surface 30 of the tip seal 29A is likely to increase. Accordingly, it is possible to suppress the local increase in surface pressures, and to suppress local wear. As a result, it is possible to increase the lifetime of the tip seal 29A.

In addition, the groove 36A is not provided in a range of the involute angle of the wrap 21 where the differential pressure ($P_H$–$P_L$) between the working chamber $S_H$ and the working chamber $S_L$ is lower than 0.1 MPa. That is, the groove 36A is not provided in a range of the involute angle of the wrap 21 where the surface pressure of the sliding surface 30 of the tip seal 29A decreases. Accordingly, the sealability can be ensured without accompanying a reduction of the surface pressure more than necessary.

Similarly to the tip seal 29A, the advantages mentioned above can be attained about the tip seal 29B according to the present embodiment also.

Figure 7:
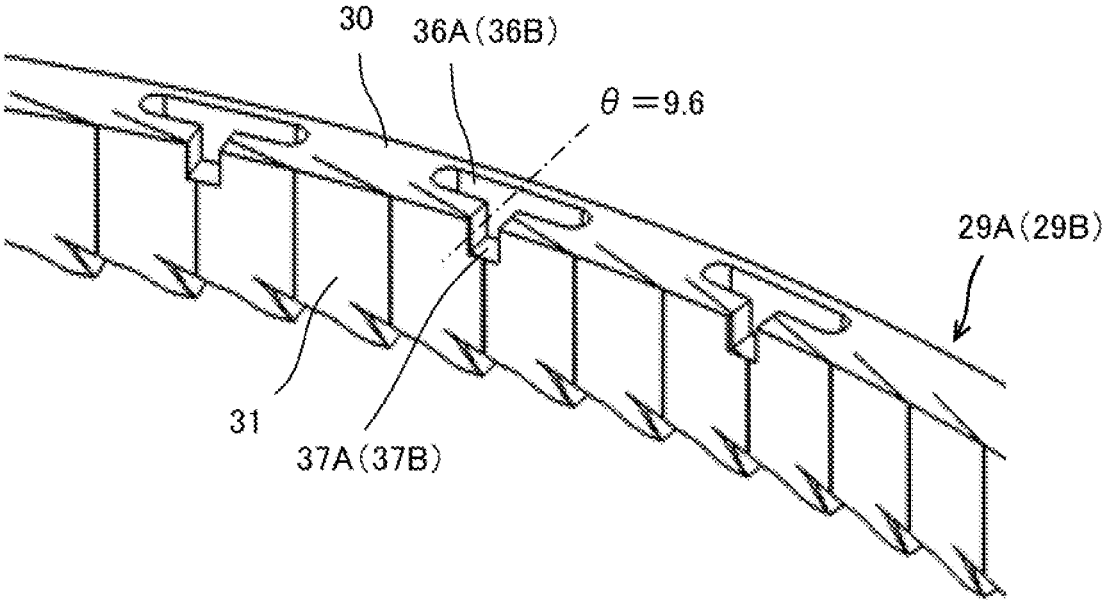
FIG. 7 is a perspective view depicting the structure of a main portion of a tip seal in a first modification example to which the present invention is applied.

Note that whereas each of the tip seals 29A and 29B has one set of a groove and a communication groove in the case of the example explained in the first embodiment, this is not the sole example. For example, as depicted in FIG. 7, each of the tip seals 29A and 29B may have a plurality of sets of grooves and communication grooves as long as they are in a range of the involute angle of the wrap where the differential pressure ($P_H$–$P_L$) between the working chamber $S_H$ and the working chamber $S_L$ is equal to or higher than 0.1 MPa (i.e. where the relative position is 0.10 to 0.33).

Figure 8:
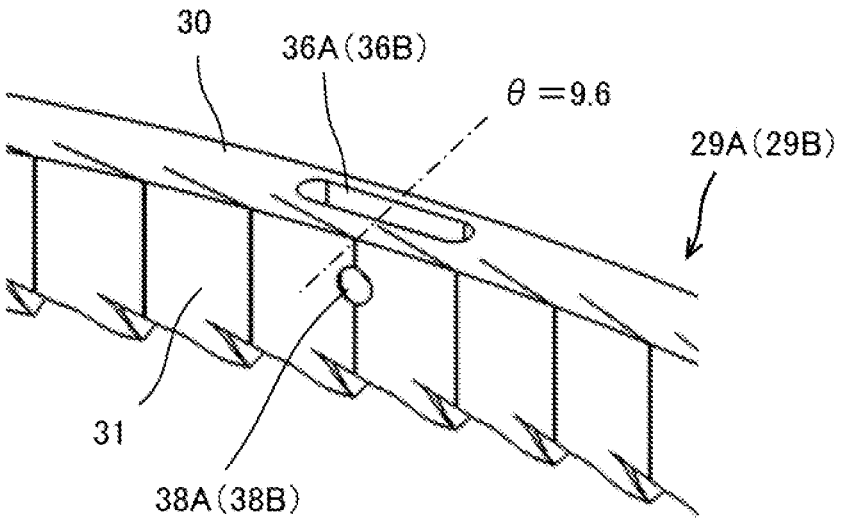
FIG. 8 is a perspective view depicting the structure of a main portion of a tip seal in a second embodiment to which the present invention is applied.

A second embodiment to which the present invention is applied is explained by using FIG. 8. Note that portions in the present embodiment that are equivalent to their counterparts in the first embodiment are given the same reference characters, and explanations thereof are omitted as appropriate.

FIG. 8 is a perspective view depicting the structure of a main portion of a tip seal in the present embodiment.

The tip seal 29A according to the present embodiment has the groove 36A similarly to the first embodiment. In addition, instead of the communication groove 37A, the tip seal 29A according to the present embodiment has a communication hole 38A that does not have an opening on the sliding surface 30. Similarly to the communication groove 37A, the communication hole 38A establishes communication between the inside of the groove 36A and the working chamber $S_H$ on the inner side in the wrap width direction. In addition, similarly to the communication groove 37A, the communication hole 38A is shorter than the groove 36A in the seal extension direction.

The tip seal 29B according to the present embodiment has the groove 36B similarly to the first embodiment. In addition, instead of the communication groove 37B, the tip seal 29B according to the present embodiment has a communication hole 38B that does not have an opening on the sliding surface 30. Similarly to the communication groove 37B, the communication hole 38B establishes communication between the inside of the groove 36B and the working chamber $S_H$ on the inner side in the wrap width direction. In addition, similarly to the communication groove 37B, the communication hole 38B is shorter than the groove 36B in the seal extension direction.

About the tip seal 29A according to the present embodiment also, similarly to the first embodiment, it is possible to suppress local wear while ensuring the sealability. In addition, about the tip seal 29A according to the present embodiment, the surface pressure of the sliding surface 30 decreases as compared to the first or second conventional technology mentioned above not only at cross sectional positions having the groove 36A, but not having the communication hole 38A, but also at a cross sectional position having the groove 36A and the communication hole 38A. Accordingly, it is possible to further suppress local wear.

Similarly to the tip seal 29A, the advantages mentioned above can be attained about the tip seal 29B according to the present embodiment also.

Note that whereas the communication hole 38A is shorter than the groove 36A in the seal extension direction, and the communication hole 38B is shorter than the groove 36B in the seal extension direction in the case of the example explained in the second embodiment, this is not the sole example. The communication hole 38A may have the same length as the groove 36A in the seal extension direction or may be longer than the groove 36A. The communication hole 38B may have the same length as the groove 36B in the seal extension direction or may be longer than the groove 36B. In this case also, advantages similar to those described above can be attained.

Figure 9:
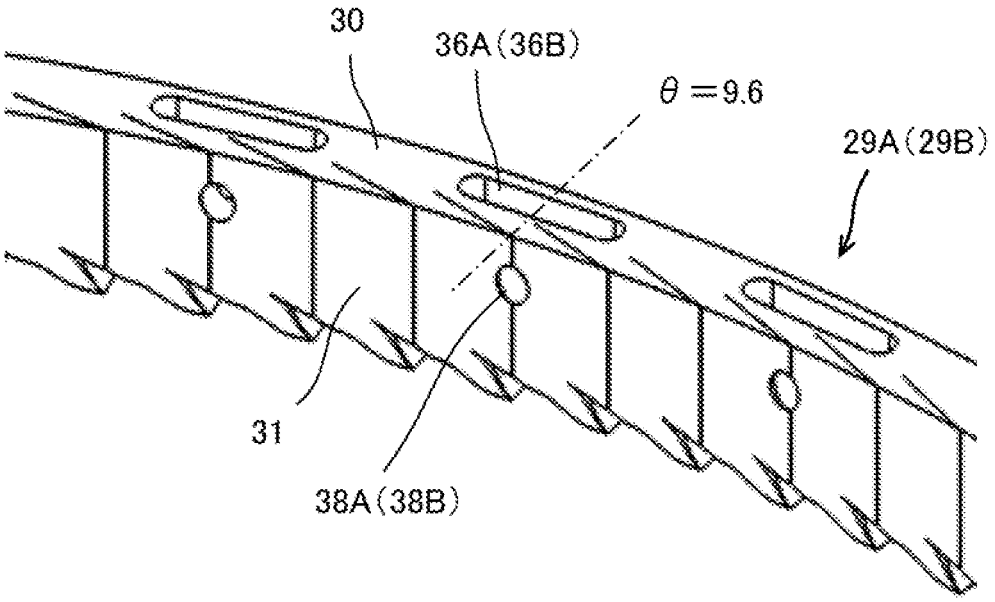
FIG. 9 is a perspective view depicting the structure of a main portion of a tip seal in a second modification example to which the present invention is applied.
Figure 10:
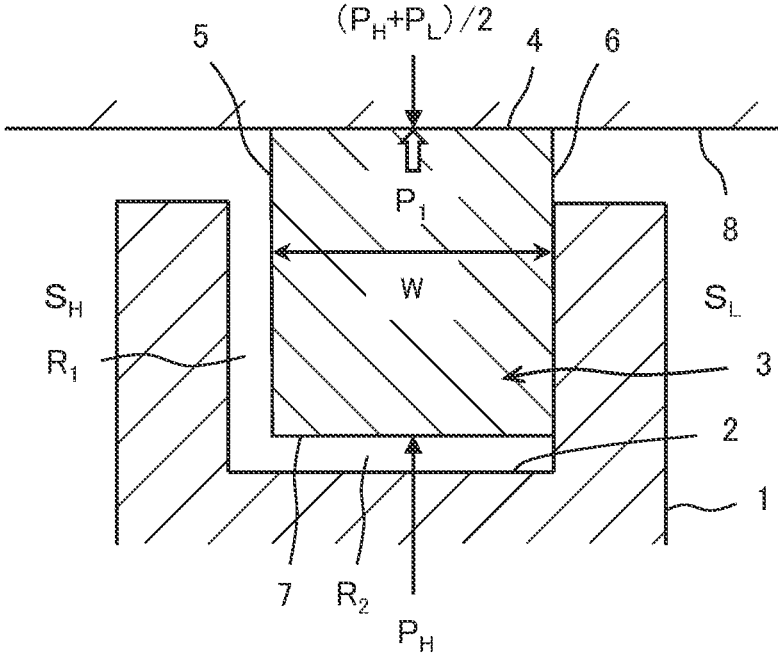
Prior Art FIG. 10
FIG. 10 is a wrap widthwise cross sectional view depicting the structure of a tip seal in a first conventional technology.
Figure 11:
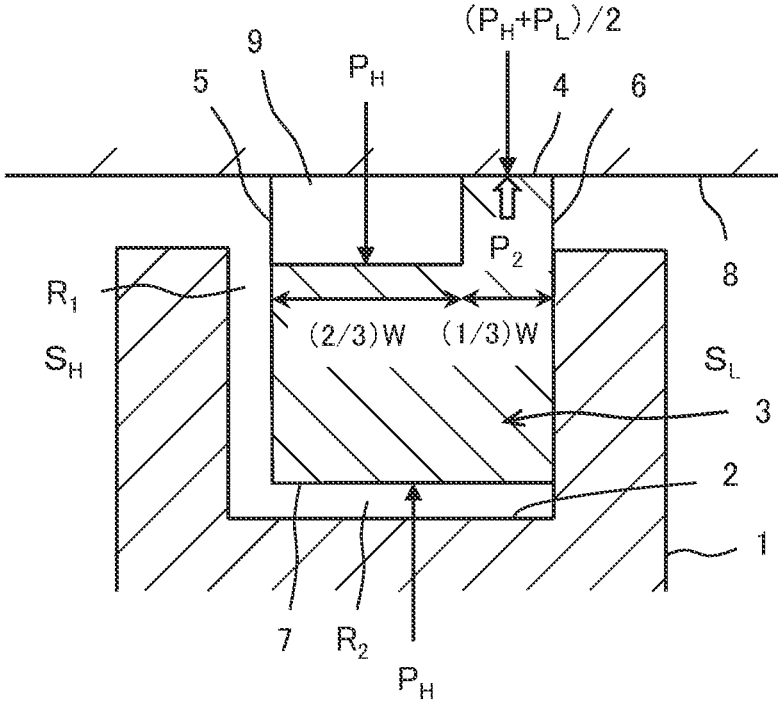
Prior Art FIG. 11
FIG. 11 is a wrap widthwise cross sectional view depicting the structure of a tip seal in a second conventional technology.

In addition, whereas each of the tip seals 29A and 29B has one set of a groove and a communication hole in the case of the example explained in the second embodiment, this is not the sole example. For example, as depicted in FIG. 9, each of the tip seals 29A and 29B may have a plurality of sets of grooves and communication holes as long as they are in a range of the involute angle of the wrap where the differential pressure ($P_H$–$P_L$) between the working chamber $S_H$ and the working chamber $S_L$ is equal to or higher than 0.1 MPa (i.e. where relative positions are 0.10 to 0.33).

In addition, whereas each of the tip seals 29A and 29B has a groove and a communication groove or communication hole in the cases of the examples explained in the first and second embodiments, these are not the sole examples. Only one of the tip seals 29A and 29B may have a groove and a communication groove or communication hole.

In addition, both the wrap 16 of the fixed scroll 11 and the wrap 21 of the orbiting scroll 12 have seal grooves formed thereon, and tip seals are inserted into the seal grooves in the cases of the examples explained in the first and second embodiments, these are not the sole examples. Only one of the wrap 16 of the fixed scroll 11 and the wrap 21 of the orbiting scroll 12 may have a seal groove formed thereon, and a tip seal may be inserted into the seal groove. Then, the tip seal may have a groove and a communication groove or communication hole.

Note that whereas the scroll type compressor is an application subject of the present invention in the examples explained thus far, these are not the sole examples. That is, the present invention may be applied to another scroll type fluid machine (specifically, a scroll type vacuum pump, etc.).

DESCRIPTION OF REFERENCE CHARACTERS

11: Fixed scroll
12: Orbiting scroll
13: Drive shaft
15: Mirror plate
16: Wrap
20: Mirror plate
21: Wrap
28A, 28B: Seal groove
29A, 29B: Tip seal
30: Sliding surface
36A, 36B: Groove
37A, 37B: Communication groove (communication hole)
38A, 38B: Communication hole

The invention claimed is:

1. A scroll fluid machine comprising:

a fixed scroll having a first mirror plate and a helical wrap provided upright on the first mirror plate;

an orbiting scroll having a second mirror plate and a helical wrap provided upright on the second mirror plate;

a drive shaft that causes the orbiting scroll to orbit relative to the fixed scroll; and a helical tip seal inserted into a seal groove formed at least in one of the wrap of the fixed scroll and the wrap of the orbiting scroll, a plurality of working chambers being formed between the wrap of the fixed scroll and the wrap of the orbiting scroll, wherein the tip seal has a tip seal groove that has an opening at a central portion in a seal width direction on a sliding surface of the tip seal, a plurality of bottom lips disposed along a bottom surface of the tip seal at predetermined intervals in a seal extension direction, and a communication hole that establishes communication between an inside of the tip seal groove and a working chamber on an inner side in a wrap width direction, the communication hole is shorter than the tip seal groove in the seal extension direction, one of the communication hole is provided for one of the tip seal groove, and the tip seal groove is shorter than a length of two of the predetermined intervals in the seal extension direction.

2. The scroll fluid machine according to claim 1, wherein the tip seal groove is provided in a range where a differential pressure is equal to or higher than 0.1 MPa between the working chamber on the inner side in the wrap width direction and a working chamber on an outer side in the wrap width direction, the working chambers being adjacent to each other with the wrap interposed therebetween.

3. The scroll fluid machine according to claim 2, wherein the tip seal groove is not provided outside the range.

4. The scroll fluid machine according to claim 3, wherein the tip seal groove is provided at an involute angle of the wrap at which the differential pressure between the working chamber on the inner side in the wrap width direction and the working chamber on the outer side in the wrap width direction, the working chambers being adjacent to each other with the wrap interposed therebetween, is a highest.

5. The scroll fluid machine according to claim 1, wherein where a relative position is defined such that an involute angle of the wrap at an inner end of the wrap is converted into 0, and the involute angle of the wrap at an outer end of the wrap is converted into 1, the tip seal groove is provided in a range where the relative position is 0.10 to 0.33.

6. The scroll fluid machine according to claim 5, wherein the tip seal groove is not provided outside the range.

7. The scroll fluid machine according to claim 5, wherein the tip seal groove is provided at an involute angle of the wrap at which the differential pressure between the working chamber on the inner side in the wrap width direction and a working chamber on an outer side in the wrap width direction, the working chambers being adjacent to each other with the wrap interposed therebetween, is a highest.

8. The scroll fluid machine according to claim 1, wherein the communication hole is a communication groove that has an opening on the sliding surface of the tip seal.

9. The scroll fluid machine according to claim 1, wherein the communication hole does not have an opening on the sliding surface of the tip seal.

10. The scroll fluid machine according to claim 1, wherein the working chambers are operated in a state free of oil supply.

11. The scroll fluid machine according to claim 1, wherein the tip seal has at least two sets of the tip seal groove and the communication hole.

* * * * *